US005890449A

United States Patent [19]

Moody

[11] Patent Number: 5,890,449

[45] Date of Patent: Apr. 6, 1999

[54] TORPEDO TUBE TEST PLUG

[75] Inventor: Paul E. Moody, Barrington, R.I.

[73] Assignee: The United States of America as represented by the Secretary of the Navy, Washington, D.C.

[21] Appl. No.: 954,888

[22] Filed: Oct. 9, 1997

[51] Int. Cl.[6] ..... B63G 8/00

[52] U.S. Cl. ..... 114/238; 114/20.1; 114/316

[58] Field of Search ..... 114/238, 312, 114/316, 20.1; 89/1.809, 1.81

[56] References Cited

U.S. PATENT DOCUMENTS 3,145,617 8/1964 Gondek ..... 114/238

*Primary Examiner*—Charles Jordan
*Assistant Examiner*—M. J. Lattig
*Attorney, Agent, or Firm*—Michael J. McGowan; James M. Kasischke; Prithvi C. Lall

[57] ABSTRACT

A combination torpedo tube test plug and muzzle door for a torpedo tube includes a circumferential land formed at an extreme muzzle end of the torpedo tube. The circumferential land has an inner peripheral diameter less than an inner peripheral diameter of the torpedo tube, and an inner peripheral transition surface contiguously joining the inner peripheral surface of the torpedo tube. An abutting face is formed on an end of the muzzle door facing the circumferential land. A lip extension extends from the abutting face. The lip extension includes an outer peripheral surface mating with the inner peripheral surface of the circumferential land, and a device for selectively securing the lip extension to the inner peripheral surface of the circumferential land, wherein separation of the muzzle door from the torpedo tube is prevented.

16 Claims, 4 Drawing Sheets

TORPEDO TUBE TEST PLUG

STATEMENT OF GOVERNMENT INTEREST

The invention described herein may be manufactured and used by, or for, the government of the United States of America for governmental purposes without the payment of any royalties thereon or therefor.

BACKGROUND OF THE INVENTION (1) Field of the Invention

This invention generally relates to a torpedo tube test plug. More particularly, this invention is intended to eliminate the need for a conventional or known submarine torpedo tube test plug, thereby eliminating the cost for the plug, and to simplify the procedure for pressure testing a torpedo tube.

(2) Description of the Prior Art

Existing torpedo tube test plugs are substantially similar to that shown in FIGS. 1 through 8 of the present application by way of example only. In particular, a breech door at a breech end (not shown) of a torpedo tube barrel 10 and all of the torpedo tube mechanisms are subjected to sea pressure from within the torpedo tube 10 under normal operating conditions.

However, as particularly shown in FIGS. 3 and 6, a muzzle door 16 at a muzzle end 22 of the torpedo tube 10 is only subjected to pressure when it is closed and an ambient sea pressure is greater than a pressure within the torpedo tube barrel 10. This excessive pressure condition occurs whenever the torpedo tube breech door (not shown) is open, the torpedo tube 10 is not flooded, the torpedo tube 10 is flooded but not pressure equalized, or the ship is diving faster than the pressure equalization system can keep up with the increase in sea pressure. Therefore, the conventional muzzle door 16 is designed to withstand pressure from the sea rather than from inside of the torpedo tube 10.

For this reason, a muzzle door gasket 18 is known to be designed and provided in connection with the muzzle door 16 so that an increase in depth will improve the sealing capabilities of the muzzle door 16; however, the torpedo tube muzzle door mechanism with a hydraulic power cylinder has insufficient power or force to hold the muzzle door 16 closed with high internal pressure.

FIGS. 1 and 2, in particular, reflect an initial known configuration for a torpedo tube test plug 20. The torpedo tube test plug 20 is used to plug the muzzle end 22 of the torpedo tube 10 when it is necessary to pressurize the torpedo tube 10 to validate its strength or tightness.

In operation, the muzzle door 16 of the torpedo tube barrel 10 is opened and the torpedo tube test plug 20 is slid into the muzzle end 22 of the torpedo tube barrel 10. The test plug 20 has a seal 24 which seals against an interior surface of the torpedo tube 10. A circular segmented key 26 having at least four segments 26*a*, 26*b*, 26*c*and 26*d* is then placed into a keyway 28 in the torpedo tube 10 and each segment 26*a*, 26*b*, 26*c*, and 26*d* is bolted to the test plug 20. As shown, a plurality of bolt apertures 12 are provided through which corresponding bolts 14 are inserted for securing the segments 26*a*, 26*b*, 26*c*, and 26*d* to the test plug 20. Finally, a special guide slot plug 30 is installed to seal a guide stud slot 32.

This configuration has been very effective for its intended purpose and has been used for many years. Some disadvantages do exist, however, including that the test plug 20 can only be installed when a ship is in drydock. Another disadvantage is that the manufacturing, storage, installation and removal, all add considerably to the cost associated with high pressure testing of a torpedo tube 10.

When the SSN 21 Class was being developed, it was decided to overcome the disadvantage associated with the necessity to drydock a ship for installation of a test plug. FIGS. 3 through 6 reflect the testing configurations which were developed thereafter.

In this configuration, referring to FIGS. 3 and 4, the muzzle door 16 is actually used to seal the muzzle end 22 of the torpedo tube. However, in order to prevent the muzzle door 16 from lifting off its seat when pressure is applied to the inside of the torpedo tube 10, sixteen pie shaped segments 34 are keyed into the torpedo tube barrel 10 and bolted with a plurality of bolts 36 directly into the muzzle door 16. When pressure is applied to the inside of the muzzle door 16, the pie shaped segments 34 pull attachment bolts 36 such that a pointed end 38 of the segments tend to cantilever toward the center 40 of the door 16. This bending of the pie shaped segments 34 at the pointed end 38 thereof, could produce high stresses in the torpedo tube keyway 28. In order to counteract this situation, a center support cylinder 42 is placed in the center 40 of the door 16 to prevent the segments 34 from bending and producing the high stress area.

This fixture eliminates the need for a separate test plug and may be installed while the ship is waterborne. However, some disadvantages remain, including that torpedo tube lands 44 and 46 have to be removed in order to install the sixteen segments 34. These lands 44 and 46 are bolted and pinned to the inside of the torpedo tube barrel 10 and their removal and re-installation is a substantial undertaking. In addition, once the lands 44 and 46 are removed, the installation of the sixteen segments 36 is difficult and time consuming as the installer has to lay in the torpedo tube barrel while lifting, positioning and bolting rather heavy pieces in locations which are awkward to access.

With the development of the New Attack Submarine it was decided that it was still desirable to pressure test a torpedo tube while the ship was waterborne, but a clamping system was desired which would not require the removal of the torpedo tube lands 44 and 46.

The clamping mechanism designed for the New Attack submarine is reflected by FIGS. 5–8. In this configuration, four fixtures 48*a*, 48*b*, 48*c*, and 48*d* are manufactured so that they fit between the torpedo tube lands 44 and 46 and are keyed into the keyway 28 in the torpedo tube barrel. Each fixture 48*a*, 48*b*, 48*c*, and 48*d* is held in place by fasteners 50 which hold the respective fixture to the barrel 10. Once the fixtures 48 are held to the barrel 10, four bolts 52 are threaded into the muzzle door 16. The design is a significant improvement over the previous design but it still requires the installation of a plurality of bolts 50 and 52 and four rather large and heavy segments 48 in an extremely cramped working space. In addition, the fasteners and segments must be stored and then carried through the length of the torpedo tube 10 to their installation location.

None of the prior art teaches or suggests a torpedo tube test plug as disclosed in the present application which can be easily installed while the submarine is waterborne.

SUMMARY OF THE INVENTION

Therefore, it is an object of this invention to provide a torpedo tube test plug which solves the problems found in the above prior art.

Another object is that such problems be solved while maintaining the capabilities and features at a lower cost with no component storage requirements.

In accordance with one aspect of this invention, there is provided a combination torpedo tube test plug and muzzle door for a muzzle end of a torpedo tube, including an integrally formed circumferential land formed at an extreme muzzle end of the torpedo tube. The circumferential land has an inner peripheral diameter which fits within the torpedo tube, and an inner peripheral transition surface which joins the inner surface of the torpedo tube with the inner peripheral surface of the integrally formed circumferential land. An abutting face is formed on an end of the muzzle door confronting a terminal end of the circumferential land. A lip extension protrudes from the abutting face to mate with the inner peripheral surface of the circumferential land. Means are provided for selectively securing the lip extension to the inner peripheral surface of the circumferential land, wherein separation of the muzzle door from the torpedo tube is prevented.

BRIEF DESCRIPTION OF THE DRAWINGS

The appended claims particularly point out and distinctly claim the subject matter of this invention. The various objects, advantages and novel features of this invention will be more fully apparent from the reading of the following detailed description in conjunction with the accompanying drawings in which like reference numerals refer to like parts, and of which:

DESCRIPTION OF THE PREFERRED EMBODIMENT

Figure 2:
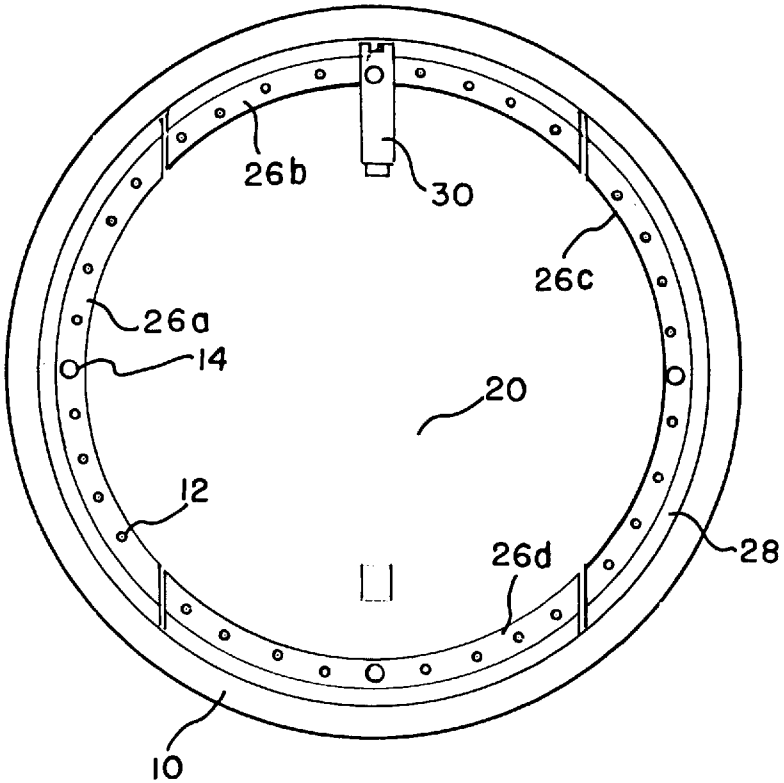
FIG. 2 PRIOR ART
FIG. 2 is an end view of the first prior art embodiment shown in FIG. 1.
Figure 1:
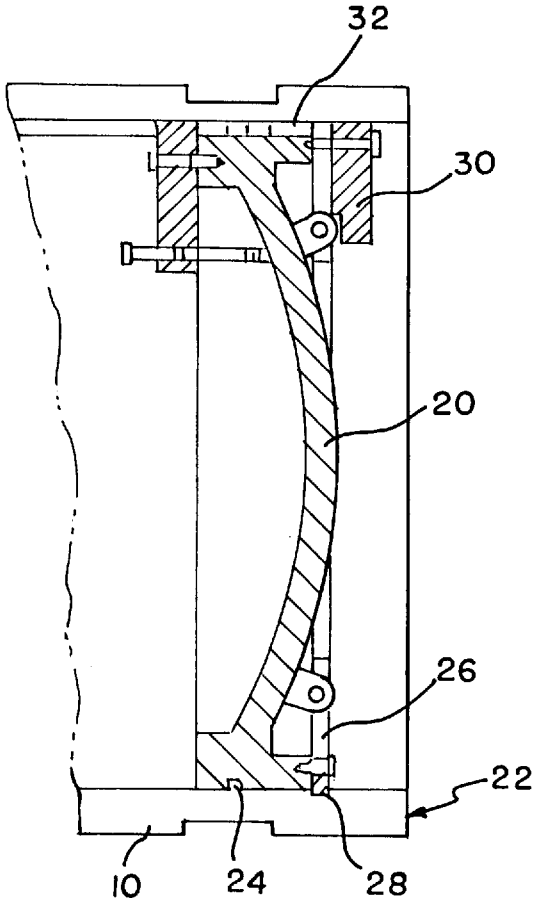
FIG. 1 PRIOR ART
FIG. 1 is a side sectional view of a first prior art torpedo tube test plug.
Figure 4:
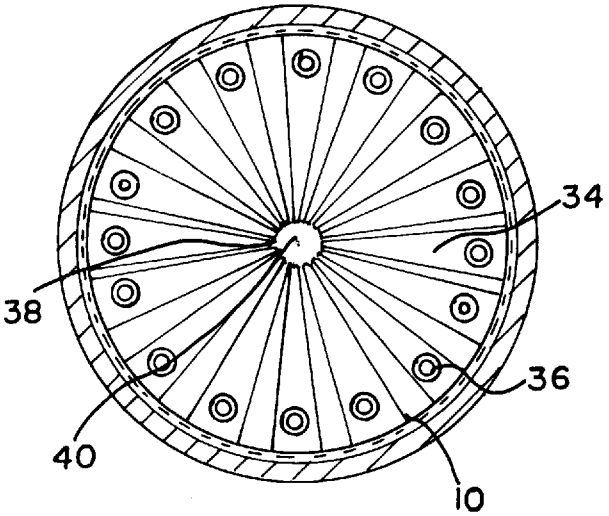
FIG. 4 PRIOR ART
FIG. 4 is an end view taken along lines 4—4 of the modified prior art embodiment shown in FIG. 3.
Figure 3:
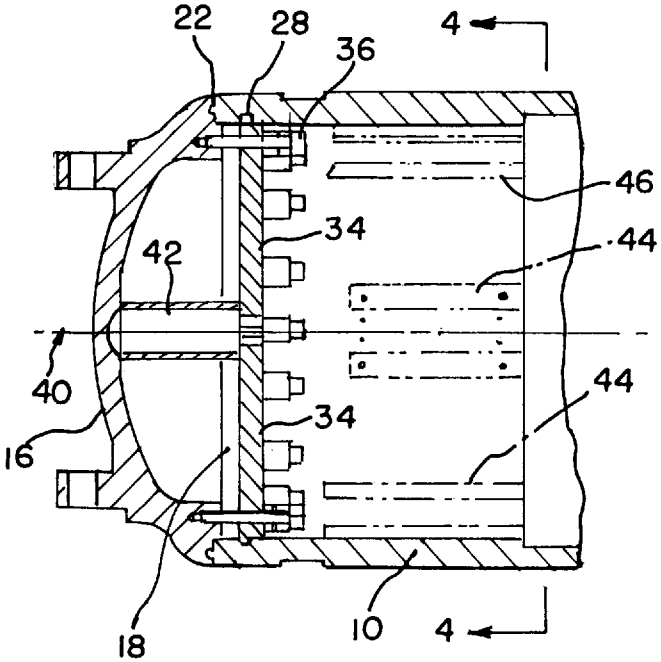
FIG. 3 PRIOR ART
FIG. 3 is a side sectional view of a modified prior art torpedo tube test plug.
Figure 5:
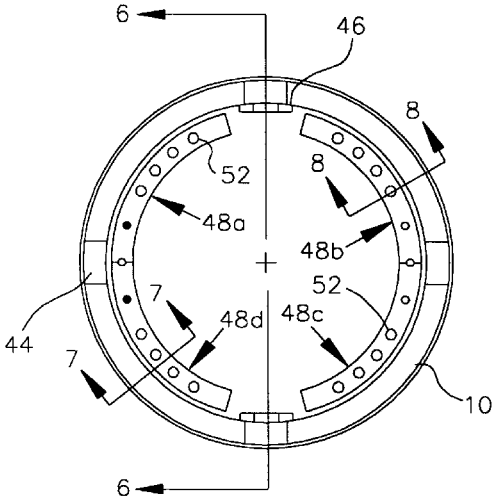
FIG. 5 PRIOR ART
FIG. 5 is an end view of a further modified prior art torpedo tube test plug taken along lines 5—5 of FIG. 6.
Figure 6:
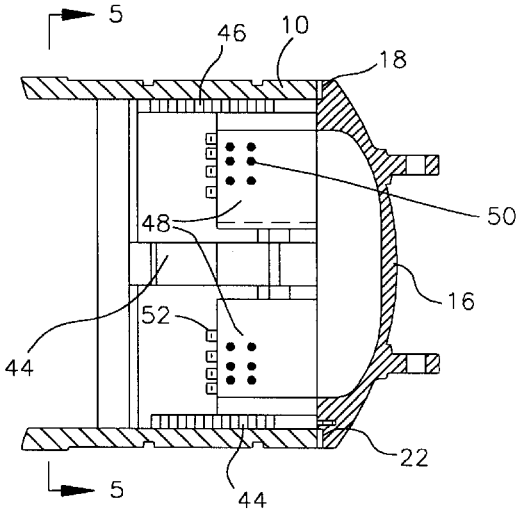
FIG. 6 PRIOR ART
FIG 6 is a side sectional view of the further modified prior art embodiment taken along lines 6—6 in FIG. 5.
Figure 7:
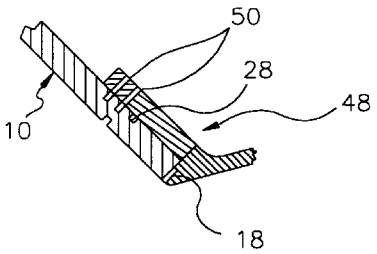
FIG. 7 PRIOR ART
FIG. 7 is a sectional view taken along lines 7—7 in FIG. 5.
Figure 8:
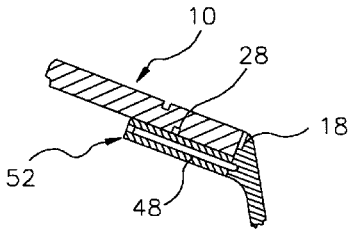
FIG. 8 PRIOR ART
FIG. 8 is a sectional view taken along lines 8—8 of FIG. 5.
Figure 10:
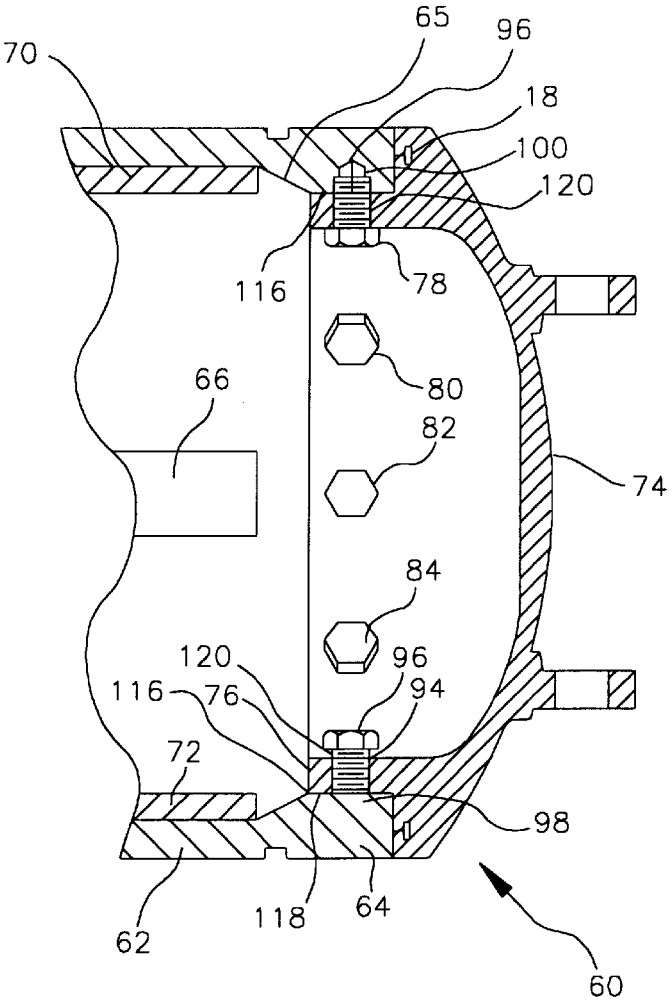
FIG. 10 is a side sectional view of the torpedo tube test plug shown in FIG. 9.
Figure 9:
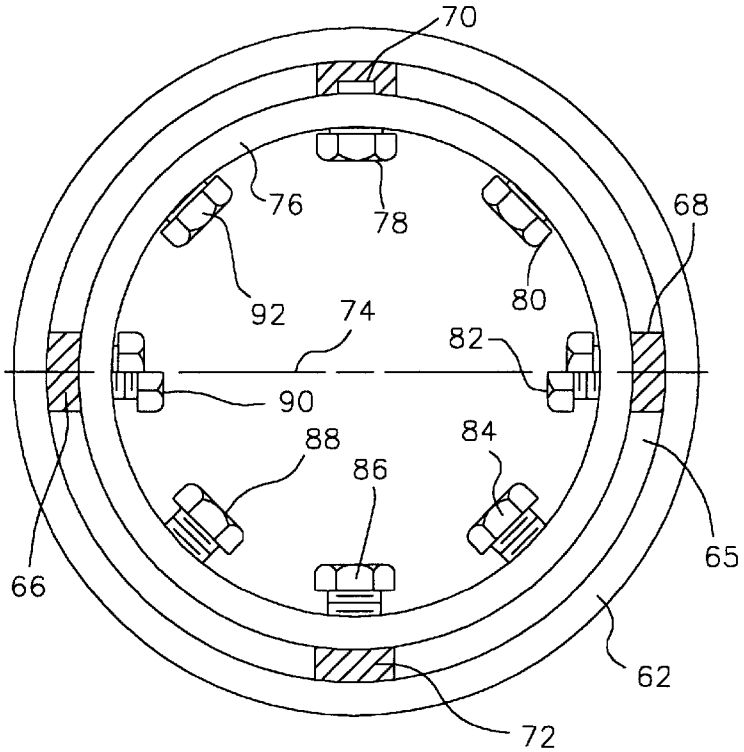
FIG. 9 is an end view of the torpedo tube test plug according to the present invention.

FIGS. 9 and 10 show the configuration for a torpedo tube pressure test according to this invention.

It should be understood that a muzzle door such as muzzle door 74 is generally operated by a hydraulic cylinder or similar mechanism (not shown). The invention is utilized in the event further securement of the muzzle door is required such as in a torpedo tube pressure testing environment. In this and other instances explained below, the simple closing of the muzzle door 74 by means of a hydraulic cylinder or the like is insufficient to maintain the muzzle door in a secure locking engagement with a torpedo tube 62. Accordingly, the arrangement of the present invention as further described hereinbelow is an advanced securing or locking of the muzzle door 74 to the torpedo tube 62.

The goal of the present invention was accomplished by eliminating the internal circumferential keyway described above in connection with the prior art which is typically machined into a muzzle end 60 of a torpedo tube barrel 62. This eliminates the cost of the machining and any stress concentrations which relate to its presence and use.

The second feature of the invention is to locate an integral circumferential land 64 inside the extreme muzzle end 60 of the torpedo tube 62. A circumferential transition surface 65 is formed between barrel 62 and land 64. This circumferential land 64 is located muzzleward of each of horizontal lands 66 and 68, an upper land 70 and a lower land 72. A muzzle door 74 is built, to generally the same configuration as previous muzzle doors except that it is configured to have a lip 76 which fits against an inner peripheral surface of the circumferential land 64 inside the torpedo tube 62 when the muzzle door 74 is closed (as shown). Lip 76 has a plurality of threaded fastener apertures spaced circumferentially thereabout. Mounted in these threaded fastener apertures are eight identically configured locking bolts 78, 80, 82, 84, 86, 88, 90, and 92. Each bolt 78 through 92 has a locking pellet 94 which prevents vibration induced rotation regardless as to the bolt being in its engaged or withdrawn position. Obviously, other kinds of locking fasteners, well known in the art, can be used for this purpose. Additionally, each bolt 78 through 92 has a circular tip 96 integrally formed with the respective bolt and located at the end of the bolt beyond its threaded portion 120.

The circumferential land portion 64 of the torpedo tube barrel 62 has eight holes which align with locking bolts 78 through 92 and are only slightly larger than the circular tips 96 of each of the bolts 78 through 92. Two of the holes are shown as 98 and 100.

The upper portion of FIGS. 9 and 10 show locking bolts 78, 80 and 92 engaged into the barrel holes while the lower portion of FIGS. 9 and 10 show locking bolts 84, 86 and 88 in their normal (or disengaged) position. FIG. 9 shows bolts 82 and 90 split to illustrate the difference in these positions.

The inside diameter of the circumferential land 64 may be tapered to a funnel configuration 118 while the outer peripheral surface of the lip 76 of the muzzle door 74 is tapered at 116 to match the corresponding configuration 118 of the circumferential land 64. This permits the muzzle door 74 to swing into the circumferential land 64 in one continuous operation in lieu of requiring an axial movement of the muzzle door mechanism. The actual configuration of these tapers is determined by the geometry of the muzzle door hinge location as well as the size of relative components.

When the locking bolts 78 through 92 are engaged in the barrel holes and pressure is applied within the torpedo tube 62, the eight locking bolt tips 96 are subjected to a shear stress. However the quantity and size of components can be easily designed with a satisfactory safety factor, as ample space is available for a robust design.

The advantages of the disclosed design are such that a torpedo tube 62 can be pressure tested while waterborne, the locking bolts 78 through 92 can be stored in the muzzle door 74 when not in use, the locking bolts 78 through 92 are readily available for use, the only tool needed by the installer is a wrench, no component parts need to be assembled to lock the door 74 in place, and the design is simple and inexpensive. Still further, the torpedo tube lands need not be removed for the lock to be effective. No dockside blanking plugs are required, no component parts need to be manhandled, the stress concentration resulting from a circumferential keyway is eliminated, implementing the lock is a rapid operation, the lock can be used for an emergency situation—if warranted, and this lock can be used to replace the present torpedo tube test plug and lock the muzzle door closed under certain conditions such as launching a ship or for safety reasons when personnel are working in the muzzle door/muzzle door linkage area. Only one locking bolt needs to be engaged to lock the muzzle door closed if only the force from a muzzle door power cylinder is inadvertently attempting to open it. This replacement eliminates the manufacturing and installation cost associated with the use of muzzle door engaging devices.

Alternatives to the disclosed device include modification of all sizes and shapes without impacting the basic concept presented. Locking bolts can be wired in place in lieu of using locking pellets. The muzzle door mechanism may be designed to draw the door into the torpedo tube in an axial direction, therefore eliminating the need for a tapered interface between the muzzle door and the torpedo tube circumferential land.

Additionally, a spider locking mechanism may be designed to replace the eight locking bolts so that all pins are simultaneously engaged.

This invention has been disclosed in terms of certain embodiments. It will be apparent that many modifications can be made to the disclosed method and apparatus without departing from the invention. Therefore, it is the intent of the appended claims to cover all such variations and modifications as come within the true spirit of this invention.

What is claimed is:

1. A combination torpedo tube test plug and muzzle door for a muzzle end of a torpedo tube, comprising:

an integrally formed circumferential land formed at an extreme muzzle end of the torpedo tube, said circumferential land including an inner peripheral diameter less than an inner peripheral diameter of the torpedo tube, and an inner peripheral transition surface contiguously joining the inner peripheral surface of the torpedo tube with the inner peripheral surface of said integrally formed circumferential land;

an abutting face formed on an end of the muzzle door facing a terminal end of said circumferential land;

a lip extension extending from said abutting face, said lip extension including an outer peripheral surface mating with the inner peripheral surface of said circumferential land; and selective securing means for selectively securing said lip extension to the inner peripheral surface of said circumferential land, wherein separation of the muzzle door from the torpedo tube is prevented.

2. The device according to claim 1 further comprising a plurality of lands formed on the inner peripheral surface of the torpedo tube and adjacent the transition surface thereof.

3. The device according to claim 1 further comprising a distinct surface formed on the inner circumferential surface of said circumferential land and a cooperating mating surface formed on the outer peripheral surface of said lip extension, thereby positively joining said muzzle door with said circumferential land of the torpedo tube.

4. The device according to claim 3 wherein said distinct surface is a taper to a funnel configuration on an inner circumferential surface of said circumferential land.

5. The device according to claim 4 wherein the circumferential land inner peripheral surface has a plurality of apertures formed therein.

6. The device according to claim 3 wherein the circumferential land inner peripheral surface has a plurality of apertures formed therein.

7. The device according to claim 1 wherein the circumferential land inner peripheral surface has a plurality of apertures formed therein.

8. The device according to claim 5, wherein:

said lip extension has a plurality of apertures therethrough corresponding to said circumferential land inner peripheral surface apertures; and said selective securing means is mounted through said lip extension apertures to said circumferential land inner peripheral surface apertures.

9. The device according to claim 6, wherein:

said lip extension has a plurality of apertures therethrough corresponding to said circumferential land inner peripheral surface apertures; and said selective securing means is mounted through said lip extension apertures to said circumferential land inner peripheral surface apertures.

10. The device according to claim 7, wherein:

said lip extension has a plurality of apertures therethrough corresponding to said circumferential land inner peripheral surface apertures; and said selective securing means is mounted through said lip extension apertures to said circumferential land inner peripheral surface apertures.

11. The device according to claim 8 wherein said selective securing means includes a locking bolt secured through said lip extension aperture and into said circumferential land aperture.

12. The device according to claim 9 wherein said selective securing means includes a locking bolt secured through said lip extension aperture and into said circumferential land aperture.

13. The device according to claim 10 wherein said selective securing means includes a locking bolt secured through said lip extension aperture and into said circumferential land aperture.

14. The device according to claim 11 wherein said locking bolt includes a threaded portion adjacent the head of the locking bolt, a non-threaded circular tip extending from said threaded portion and a locking pellet formed on the threaded portion of said locking bolt, said lip extension aperture being threaded and said locking pellet preventing rotational movement of said locking bolt within the lip extension aperture.

15. The device according to claim 12 wherein said locking bolt includes a threaded portion adjacent the head of the locking bolt, a non-threaded circular tip extending from said threaded portion and a locking pellet formed on the threaded portion of said locking bolt, said lip extension aperture being threaded and said locking pellet preventing rotational movement of said locking bolt within the lip extension aperture.

16. The device according to claim 13 wherein said locking bolt includes a threaded portion adjacent the head of the locking bolt, a non-threaded circular tip extending from said threaded portion and a locking pellet formed on the threaded portion of said locking bolt, said lip extension aperture being threaded and said locking pellet preventing rotational movement of said locking bolt within the lip extension aperture.

* * * * *